United States Patent [19]

Reed, Jr. et al.

[11] 4,392,895

[45] Jul. 12, 1983

[54] RAMJET FUEL

[75] Inventors: Russell Reed, Jr.; George W. Burdette; Gary W. Meyers; William R. Vuono, all of Ridgecrest, Calif.

[73] Assignee: The United States of America as represented by the Secretary of the Navy, Washington, D.C.

[21] Appl. No.: 319,159

[22] Filed: Nov. 9, 1981

[51] Int. Cl.[3] ..... C06B 45/10

[52] U.S. Cl. ..... 149/19.3; 149/19.9; 149/19.92; 60/207

[58] Field of Search ..... 149/19.3, 19.9, 19.92; 60/207

[56] References Cited

U.S. PATENT DOCUMENTS

| | | | |
|---|---|---|---|
| 2,995,431 | 8/1961 | Bice | 149/19.3 |
| 3,109,761 | 11/1963 | Cobb et al. | 149/19.3 |
| 3,203,171 | 8/1965 | Burke et al. | 149/19.3 |
| 3,441,455 | 4/1969 | Woods et al. | 149/8 |
| 3,513,043 | 5/1970 | Burnside | 149/19 |
| 3,586,552 | 6/1971 | Potts et al. | 149/19.3 |
| 3,647,891 | 3/1972 | Loudas et al. | 149/19.3 |
| 3,745,078 | 7/1973 | Alley et al. | 149/76 |
| 3,754,511 | 8/1973 | Damon et al. | 102/291 |
| 3,849,504 | 11/1974 | Mitsch | 149/19.3 |
| 3,931,374 | 1/1976 | Moutet et al. | 264/3 C |
| 4,012,244 | 3/1977 | Kaufman et al. | 149/19.3 |
| 4,013,491 | 3/1977 | Shaw et al. | 149/19.3 |
| 4,131,499 | 12/1978 | Flanigan | 149/19.3 |

*Primary Examiner*—Edward A. Miller

*Attorney, Agent, or Firm*—R. F. Beers; W. T. Skeer

[57] ABSTRACT

A solid ramjet fuel composition comprising a hydroxyl-terminated or carboxyl-terminated fluorocarbon binder, a polybutadiene prepolymer, a curative cross-linking compound, and a metal selected from the group consisting of aluminum, zirconium, amorphous boron or magnesium.

11 Claims, No Drawings

RAMJET FUEL

BACKGROUND OF THE INVENTION

1. Field of the Invention

This invention relates to the field of ramjet fuels and more particularly to solid ramjet fuels using metal particles therein.

2. Description of the Prior Art

One prior art solid ramjet fuel is hydroxyl-terminated polybutadiene, HTPB. The addition of metals to solid ramjet fuels have yielded limited improvements in burning characteristics because normally metals do not burn effectively under ramjet conditions. Although metals burn extremely well in solid propellants containing oxidizers, this success has not been achieved using ramjets where the oxidizer is separate from the fuel grain.

SUMMARY OF THE INVENTION

Although metals have been found to be difficult to burn efficiently in solid fuel ramjets, it has been discovered that metals can be burned in the presence of fluorocarbon binders. The chemistry is largely the dehalogination of the halo carbon to form metal halide and carbon, a very exothermic transformation. Thus, with a fluorocarbon and a metal such as boron or aluminum, the general reaction is shown in equation (1).

$$3(CF_2)+2M \rightarrow 2MF_3+3C \quad (1)$$

In the presence of air, the reaction with aluminum is shown by equations (2), (3), and (4).

$$(CF_2) + 2Al \longrightarrow 2AlF\cdot + C \quad (2)$$

$$AlF\cdot + O_2 \longrightarrow AlOF + O\cdot \quad (3)$$

$$C + O\cdot \xrightarrow{[o]} CO_2 \quad (4)$$

Since there are no liquid curable fluorocarbon binders composed solely of $CF_2$ groups, liquid curable hydroxyl- (HTF) and carboxyl- (CTF) terminated copolymers of vinylidene fluoride and perfluoropropylene are used. When the HTF is cured with a multi-functional isocyanate curative such as polymethylene polyphenylisocyanate (PAPI), HTF and metal mixtures produce an elastomeric propellant with good mechanical properties. The chemistry involved in the combustion of aluminum or boron with HTF propellants is shown by equations (5) or (6).

$$(CHF) + Al \xrightarrow{[o]} AlOF + CO + \tfrac{1}{2} H_2 \quad (5)$$

$$(CHF) + B \xrightarrow{[o]} BOF + CO + \tfrac{1}{2} H_2 \quad (6)$$

The solid ramjet fuels of this invention are composed of basically powdered metal, hydroxyl-terminated fluorocarbon binder (FCB(HT)), hydroxyl-terminated polybutadiene (HTPB), dimeryl diisocyanate (DDI) or polymethylene polyphenylisocyanate (PAPI), or a fuel of powdered metal, carboxyl-terminated fluorocarbon binder (CTF), HTPB and DDI, or carboxyl-terminated polybutadiene (CTPB) and trifunctional aromatic epoxide (ERLA).

One object of this invention is solid ramjet fuel compositions having increased heat release per unit of volume compared to prior fuels.

Another object of this invention is solid ramjet fuel compositions optimizing burn rate by adjusting metal particle sizes.

Another object of this invention is a solid ramjet fuel using metal particles with good mechanical properties.

A still further object of this invention is a solid ramjet fuel composition which facilitates processing.

Other objects and novel features of the invention will become apparent from the following detailed description of the invention when considered in conjunction with the claims.

DESCRIPTION OF THE PREFERRED EMBODIMENT

The general chemistry of the combustion of metal particles in solid ramjet fuels is noted in the above section. In order to test the effectiveness of metal particles in solid ramjet fuels, various compositions were evaluated as noted in Table 1.

TABLE 1

SOLID RAMJET FUEL COMPOSITIONS

| COMPOSITION | WT % | | | | |
|---|---|---|---|---|---|
| 1 | | | | | |
| FCB (HT) | 32.817 | 14.616 | 12.934 | 11.600 | 8.40 |
| DDI | 16.807 | 18.096 | 16.014 | 14.362 | 10.40 |
| HTPB | 40.643 | 54.288 | 48.042 | 43.086 | 31.20 |
| AL (5 μm) | 9.733 | 13.000 | 23.004 | 30.952 | 50.00 |
| AL:F | 1:3 | 1:1 | 2:1 | 3:1 | 7:1 |
| 2 | | | | | |
| FCB (HT) | 11.164 | 8.359 | | 6.681 | |
| DDI | 13.822 | 10.350 | | 8.272 | |
| HTPB | 41.466 | 31.050 | | 24.816 | |
| ZR (20 μm) | 33.547 | 50.241 | | 60.231 | |
| ZR:F | 1:1 | 1:1.5 | | 2:1 | |
| 3 | | | | | |
| FCB (HT) | 9.30 | 9.10 | | 9.10 | |
| PAPI | 4.54 | 4.55 | | 4.55 | |
| HTPB | 36.16 | 36.36 | | 36.36 | |
| AL | 50.00 (5 μm) | 50.00 (15 μm) | | 50.00 (30 μm) | |
| AL:F | 6:1 | 6:1 | | 6:1 | |
| 4 | | | | | |
| FCB (CT) | 34.05 | 40.0 | | 17.025 | |
| ERLA | 8.064 | 7.0 | | 9.364 | |
| CTPB | 27.86 | 18.40 | | 43.61 | |
| AL (5 μm) | 30.00 | 30.00 | | 30.00 | |
| AL:F | 1:1 | 1:1.5 | | 2:1 | |

The processing of the various samples was carried out using techniques known in the art. Liquid compounds were mixed first and solids were added after because they increase the viscosity of the mixture. In the process of making the various compositions, the fluorocarbon binder, hydroxyl-terminated prepolymer of vinylidene fluoride and perfluoropropylene is mixed with hydroxyl-terminated polybutadiene, a prepolymer also. Secondly, a curative agent or cross linking agent is mixed in with the previous mixture. This compound can be either dimeryl diisocyanate or polymethylene polyphenylisocyanate. Thirdly, metal particles are added to the composition obtained in the previous two steps. The resultant rubbery ramjet fuel composition is cast into desired containers. A carboxyl-terminated fluorocarbon binder with the same backbone structure can also be used in conjunction with a carboxyl-terminated polybutadiene (CTPB) prepolymer and a powdered metal.

This mixture can be cured with a multifunctional epoxy such as the triglycidyl derivative of para-aminophenol (ERL-0510, Giegy).

Composition 1 of Table 1 is composed of hydroxyl-terminated fluorocarbon binder, (FCB(HT)), dimeryl diisocyanate, (DDI), hydroxyl-terminated polybutadiene, (HTPB), and five micrometer aluminum metal particles. The weight percentages of the various compounds of the solid ramjet fuel are noted also in Table 1. The ratio of aluminum to fluorocarbon varied from 1:3 to 7:1.

Composition 2 of Table 1 is composed of the same compounds of composition 1 except zirconium having 20 micrometer diameter particles is substituted for the aluminum of composition 1. Again the ratio of zirconium to fluorocarbon is varied from 1:1 to 2:1. Other metals such as hafnium, amorphous boron, magnesium, and various alloys and mixtures of these metals can be used in any of the compositions shown. Metal carbides such as boron carbide can also be used.

The third composition of Table 1 replaces DDI with PAPI, polymethylene polyphenylisocyanate. Qualitative tests indicate that compositions containing 5 micrometer aluminum burns too rapidly while compositions containing aluminum powder having a diameter approximately equal to 20 micrometers burns at a satisfactory rate.

Composition 4 of Table 1 is composed of carboxyl-terminated fluorocarbon binder, (FCB(CT)), and epoxide curative, (ERLA), carboxyl-terminated polybutadiene, (CTPB), and aluminum metal particles of 5 micrometer diameter. The fluorocarbon of composition 4 was selected for testing because it is more likely to be produced in larger quantities.

Obviously, many modifications and variations of the present invention are possible in light of the above teachings and it is therefore understood that, within the scope of the disclosed inventive concept, the invention may be practiced otherwise than specifically described.

We claim:

1. A solid ramjet fuel composition comprising a functionally terminated fluorocarbon prepolymer, a functionally terminated polybutadiene prepolymer, a curative cross-linking compound for both prepolymers, and metallic fuel.

2. A solid ramjet fuel composition according to claim 1, wherein said fluorocarbon prepolymer is selected from the group consisting of hydroxyl-terminated fluorocarbon binder (FCB(HT)) and carboxyl-terminated fluorocarbon binder (FCB(CT)).

3. A solid ramjet fuel composition according to claim 2, wherein said fluorocarbon prepolymer is FCB(CT), said polybutadiene prepolymer is carboxyl-terminated polybutadiene (CTPB) and said curative cross-linking compound is trifunctional aromatic epoxide.

4. A solid ramjet fuel composition according to claim 2, wherein said fluorocarbon prepolymer is FCB(HT), said polybutadiene prepolymer is hydroxyl-terminated polybutadiene (HTPB).

5. A solid ramjet fuel composition according to claim 4, wherein said curative cross-linking compound is selected from the group consisting of dimeryl diisocyanate (DII) and polymethylene polyphenylisocyanate (PAPI).

6. A solid ramjet fuel composition according to claim 3 or 5, wherein said metallic fuel is selected from the group consisting of aluminum, zirconium, hafnium, amorphous boron, magnesium, and boron carbide.

7. A solid ramjet fuel according to claim 6, wherein said metallic fuel has a particle size range of from 5 $\mu$m to 30 $\mu$m.

8. A process of producing a solid ramjet fuel composition comprising the steps of:

mixing prepolymers of hydroxyl-terminated fluorocarbon binder (FCB(HT)) and hydroxyl-terminated polybutadiene (HTCB), or carboxyl-terminated fluorocarbon binder (FCB(CT) and carboxyl terminated polybutadiene (CTPB);

mixing said mixed prepolymers with a curative cross-linking compound therefore; and mixing metallic fuel particles into said mixed prepolymers and curative.

9. A process of producing a solid ramjet fuel composition according to claim 8 wherein said curative cross-linking compound is selected from the group consisting of dimeryl diisocyanate (DDI) and polymethylene polyphenylisocyanate (PAPI), and said prepolymers are FCB(HT) and HTPB.

10. A process of producing a solid ramjet fuel composition according to claim 8, wherein said curative compound is trifunctional aromatic epoxide, and said prepolymers are FCB(CT) and CTPB.

11. A process of producing a solid ramjet fuel composition according to claim 8, wherein the metallic fuel of said metallic fuel particles is selected from the group consisting of aluminum, zirconium, hafnium, amorphous boron, magnesium, and boron carbide.

* * * * *